US005943701A

United States Patent [19]

Seats

[11] Patent Number: 5,943,701

[45] Date of Patent: Aug. 31, 1999

[54] COMBINED HAND GLOVE AND AEROSAL REPELLANT DEVICE

[76] Inventor: Valerie V. Seats, 164 E. 122nd St., Chicago, Ill. 60628-7536

[21] Appl. No.: 09/157,930

[22] Filed: Sep. 21, 1998

Related U.S. Application Data

[60] Provisional application No. 60/064,118, Nov. 3, 1997.

[51] Int. Cl.[6] ..... A41D 19/00

[52] U.S. Cl. ..... 2/160; 2/159; 2/912; 224/217; 222/175

[58] Field of Search ..... 2/159, 160, 161.1, 2/161.2, 161.3, 163, 249, 247, 250, 912; 224/217; 222/175

[56] References Cited

U.S. PATENT DOCUMENTS

| | | | |
|---|---|---|---|
| 2,294,997 | 9/1942 | Merrion . | |
| 4,326,706 | 4/1982 | Guthrie et al. | 2/160 |
| 4,504,980 | 3/1985 | Butcher . | |
| 4,625,339 | 12/1986 | Peters . | |
| 4,805,242 | 2/1989 | Bolton . | |
| 5,003,637 | 4/1991 | Lonon . | |
| 5,088,121 | 2/1992 | Wallace . | |
| 5,095,547 | 3/1992 | Kerns . | |
| 5,276,922 | 1/1994 | Floyd, Jr. | 2/160 |
| 5,345,368 | 9/1994 | Huff | 2/160 |
| 5,673,436 | 10/1997 | Piper | 2/160 |
| 5,678,730 | 10/1997 | Fabek et al. | 2/160 |

FOREIGN PATENT DOCUMENTS

| | | | |
|---|---|---|---|
| 2587882 | 4/1987 | France | 2/160 |
| 1013381 | 12/1965 | United Kingdom | 2/161.1 |

*Primary Examiner*—Diana L. Oleksa
*Assistant Examiner*—Katherine Moran
*Attorney, Agent, or Firm*—Richard C. Litman

[57] ABSTRACT

A combined hand glove and aerosol repellent device. A small cylindrical canister of an aerosol repellent is held unobtrusively and securely in a glove and worn by a person for protection against sudden assaults from humans and animals. The repellent canister has a hook material patch which attaches to a loop material patch positioned approximately between the first and third knuckles of the index finger. The glove has a pocket which secures the bottom portion of the canister. The glove can be tipless (open fingered) or a complete glove for cold weather.

4 Claims, 3 Drawing Sheets

PRIOR
ART

COMBINED HAND GLOVE AND AEROSAL REPELLANT DEVICE

CROSS-REFERENCE TO RELATED APPLICATION

This application claims the benefit of U.S. Provisional Patent Application Ser. No. 60/064,118, filed Nov. 3, 1997.

BACKGROUND OF THE INVENTION

1. Field of the Invention

The present invention relates to a combined hand glove and aerosol device, wherein a small cylindrical canister of an aerosol repellent, (e.g., Mace™), is held unobtrusively and securely in a glove preferably made of spandex material. The invention is worn by a person for protection against sudden assaults from humans and animals. A unique position for the canister and method of activation is shown. The repellent canister has a hook material patch which attaches to a loop material patch positioned approximately between the first and third knuckles of the index finger. Therefore, bending the fingertip quickly activates the aerosol repellent. The glove has a pocket which secures the bottom portion of the canister. The glove can be tipless or a complete glove for cold weather. Other repellents such as a pepper spray and even a canine high frequency alarm can be utilized with the glove.

2. Description of Related Art

The relevant art describes various gloved devices, but fails to suggest or teach the advantageous position of the aerosol repellent canister attached to an index finger of the glove and operable by the mere bending of a fingertip. The art of interest will be discussed in the order of perceived relevance to the present invention.

U.S. Pat. No. 5,088,121 issued on Feb. 18, 1992, to Jacqueline E. Wallace describes a glove with a pocket for holding Mace and method of making same. A glove, mitten or a palmar band has a Mace container placed in a pocket crossing the palm region and activated by a thumb. Alternative methods of fastening include snaps, zippers, clips, hook and loop material, adhesives, and the like. The glove and pocket may be made of fabric, leather and the like. The glove may have fingers, partial fingers, be fingerless or be like a mitten, and it may be either right or left handed. The pocket may have an inner surface or band which is non-skid such as rubber or elastic. The pocket may be open at both ends or have a flap. However, there is no suggestion for placing the Mace canister in the upright position under an index fingertip as taught in the present invention, and contrariwise the patent teaches the singular use of the thumb for activating the Mace.

U.S. Pat. No. 4,504,980 issued on Mar. 19, 1985, to Dayton M. Butcher describes a security hand band of bright colored, waterproof cloth with reflectors and hook and loop material to attach to the hand and to hold a canister of tear gas. Again, the tear gas canister is held across the palm and activated by a thumb. The object of having a distinctive bright and reflective hand band is diametrically opposed to the purpose of the present invention wherein the aerosol repellent canister is held in an unobtrusive but ready position for use against an assault by humans or animals.

U.S. Pat. No. 2,294,997 issued on Sep. 8, 1942, to Earl P. Merrion describes a tool carrier for gloves. The tool with two handles, e.g., fruit clipping tool, is held in an attached sleeve positioned across the palm and under the thumbstall by one handle. There is no suggestion for changing the position of the sleeve.

U.S. Pat. No. 4,625,339 issued on Dec. 2, 1986, to Raymond A. Peters describes an illuminating glove having an elastic sleeve mounted on its upper side, i.e., back of hand, for holding a flashlight with a flexible mounting clip supported by a panel in the sleeve's wall. The sleeve is positioned along the thumb for the flashlight to point in the direction of the fingers. There is no suggestion for any other position on the glove.

U.S. Pat. No. 4,805,242 issued on Feb. 21, 1989, to Billie J. Bolton describes a tissue packet holder incorporated on the back of a leather ski glove. The holder has two crossing flaps held with hook and loop material. There is no suggestion for any other position on the glove for the holder.

U.S. Pat. No. 5,003,637 issued on Apr. 2, 1991, to Edward M. Lonon describes a glove with utility attachments such as a container for cigarettes, driver's license, credit cards, pens, pencils, comb, mirror, watch, radio, first aid equipment, or a decorative figure or symbol removably attached to the back of the glove with hook and loop material. There is no suggestion for any other position on the glove for the utility attachment.

U.S. Pat. No. 5,095,547 issued on Mar. 17, 1992, to Carol S. Kerns describes a self defense glove which includes a plurality of flexible metallic abrasive strips mounted to the palm side on the fingers and thumb by hook and loop material. The back surface of the glove also has a square patch. There is no suggestion for pockets or for attaching other implements to the glove.

None of the above inventions and patents, taken either singly or in combination, is seen to describe the instant invention as claimed.

SUMMARY OF THE INVENTION

Accordingly, it is a principal object of the invention to provide a combined hand glove and aerosol repellent device.

It is another object of the invention to provide a combined hand glove and aerosol repellent device wherein the repellent canister is held securely under the index finger.

It is a further object of the invention to provide a combined hand glove and aerosol repellent device wherein the repellent canister is held securely by hook and loop material and a pocket on the glove.

Still another object of the invention is to provide a combined hand glove and aerosol repellent device wherein the repellent can be expelled by the tip of the index finger pressing on the nozzle portion of the repellent canister.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention provides a combined glove and aerosol repellent device, wherein the repellent canister is held unobtrusively and securely in a hand glove. The position of the aerosol repellent canister under the index finger enables almost instantaneous response to a threatening attack by bending the fingertip.

Figure 1:
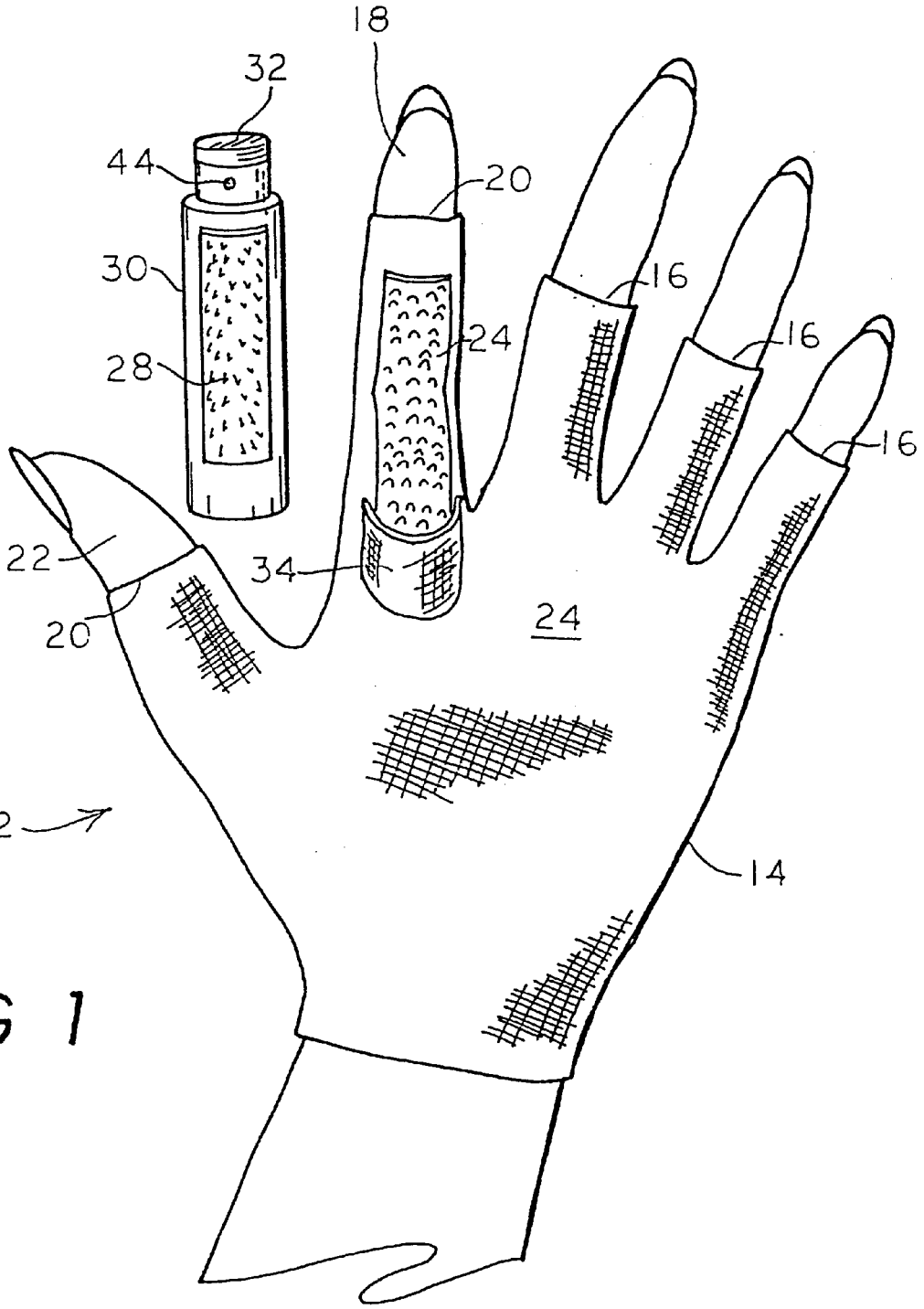
FIG. 1 is an exploded environmental and front elevational view of the present invention on a hand.
Figure 2:
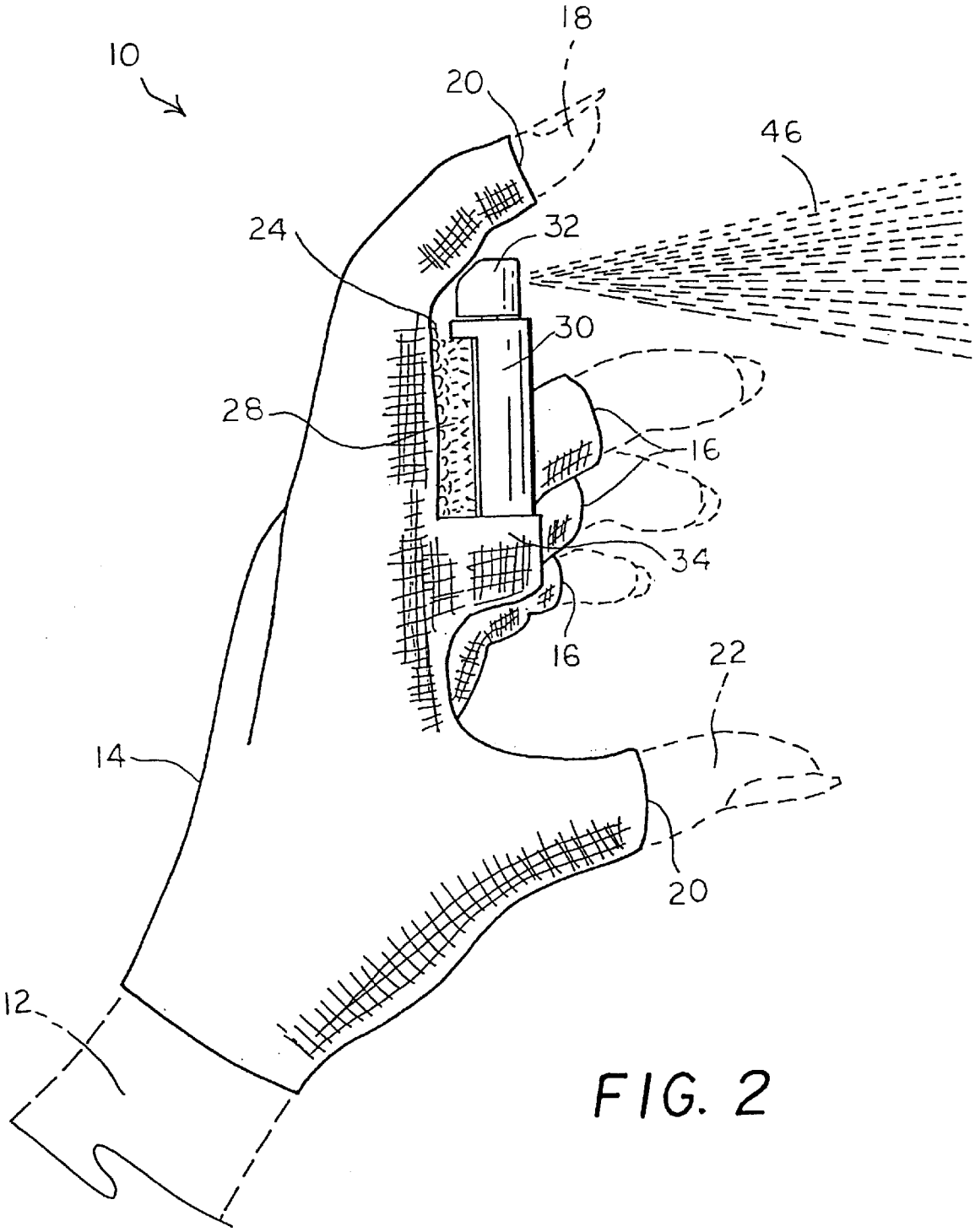
FIG. 2 is an environmental left side view of a left hand wearing and utilizing the present invention.
Figure 4:
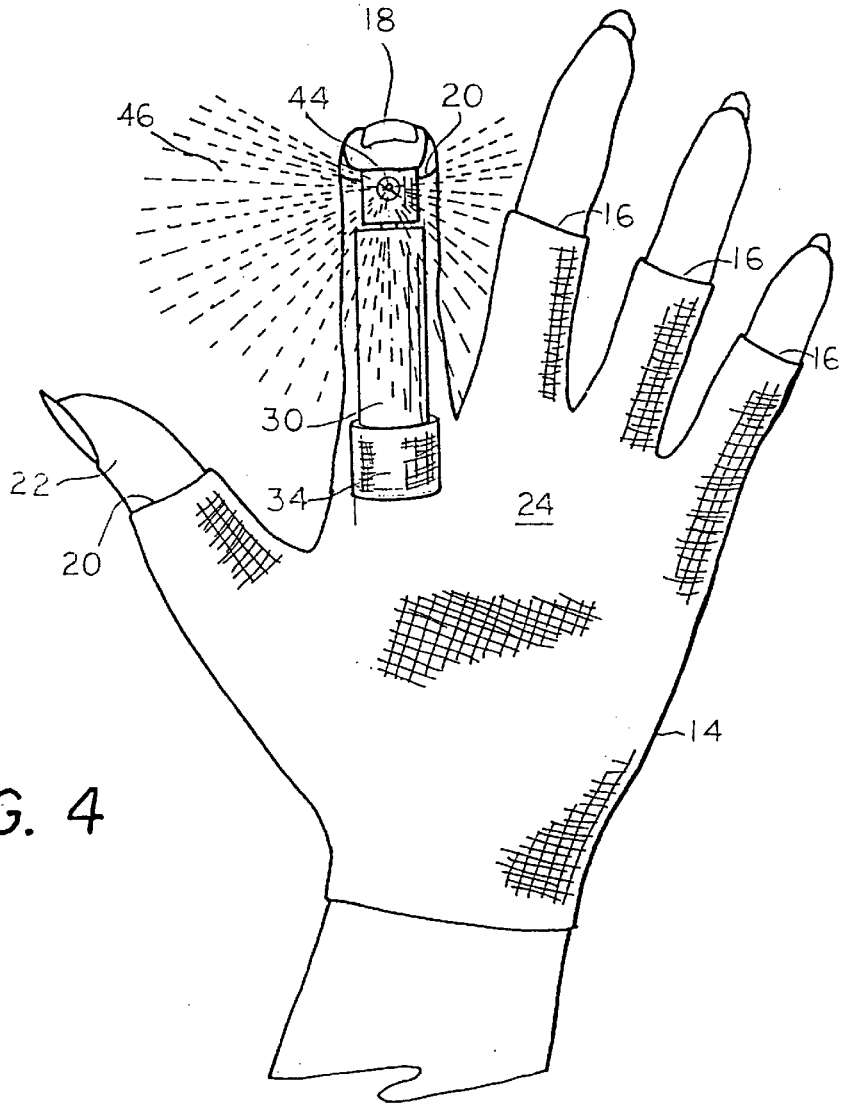
FIG. 4 is an environmental front view of the present invention being utilized.

FIG. 1 depicts the combined hand glove and aerosol repellent device 10 on a left hand 12 with a spandex glove 14 with the fingertip portions 16 for three fingers cut off to below the first knuckle except for the index finger 18 at 20 and the thumb 22. A strip or patch of loop material 24 is attached to the front surface 26 of the glove 14 under the index finger 18. A cooperating hook material patch 28 is attached to the side of an aerosol repellent canister 30. It should be noted that the location of the loop material patch 24 on the index finger 18 is essential because loop material by construction does not irritate the wearer when the canister 30 is not attached. The canister 30 has a nozzle 32 which can be readily depressed as shown in FIGS. 2 and 4 (hand shown in shadow) by bending the index finger 18 to dispense a repellent spray 46. A pocket 34 is provided on the glove 14 to support the canister 30 when it is utilized.

Figure 3:
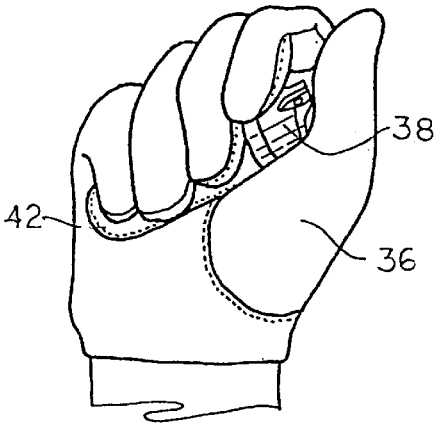
FIG. 3 is a prior art device with the aerosol repellent canister carried in a pocket based in the palm portion of a hand glove.

Turning to the prior art glove 36 and canister 38 in FIG. 3, it can be appreciated that the thumb 22, not the index finger 18, is utilized to activate the canister 30 held in a pocket 40 which traverses the palm portion 42. The disadvantage of this palm position of the prior art glove 36 resides in the fact that the canister 30 is carried in an obtrusive position which requires the user to twist one's hand towards the aggressor before dispensing the repellent. In the present invention, the user needs only to lift one's hand towards the aggressor and to bend the index finger to dispense the repellent.

It is noted that the nozzle orifice 44 is directed at the aggressor automatically and assuredly by the prepositioning of the hook material patch 28 on the canister 30. Because of the attachment of the canister 30 to the loop material patch 24 on the glove 14, again, the user is assured that the canister 30 is always directed in the correct position for immediate use.

Exemplary dimensions of the respective hook and loop patches 28 and 24 are 0.75 in. wide and 2.75 in. long. A mace case is 2.75 in. long and 2.75 in. in diameter. The pocket 34 can be located 2 in. from the top of the loop material patch 24.

The glove can be a complete glove without the tips removed and used on either hand for male or female hands. Spandex material, i.e., elastic polyurethane fabric, for the gloves is preferred, but other materials such as leather or cotton can be utilized.

As noted above, the specific repellent is not limited to a mace-like material, but can be such various materials as a pepper spray and a canine high frequency alarm which can be utilized with the glove.

It is to be understood that the present invention is not limited to the embodiments described above, but encompasses any and all embodiments within the scope of the following claims.

I claim:

1. A combined hand glove and aerosol repellent device comprising:

a hand glove having a palm portion and at least individual fingers including an index finger, said index finger having an inside surface;

a cylindrical canister having a bottom portion and containing an aerosol repellent, and further having a dispensing nozzle;

a patch of loop material positioned on said inside surface of said index finger;

a cooperating patch of hook material positioned on said cylindrical canister; and a pocket positioned on said palm portion of said hand glove adjacent to said index finger, said canister being secured by said hook and loop material and in part by said pocket which covers said bottom portion of said canister;

whereby a wearer of said combined hand glove and aerosol repellent device can immediately activate said device by pressing said nozzle with said index finger upon being threatened.

2. The device according to claim 1, said hand glove being made of spandex.

3. The device according to claim 1, including said hand glove being selected from a whole glove and a fingertip-less glove.

4. The device according to claim 1, said hand glove being a fingertip-less glove, with said index finger having a longer covering than the remaining fingers.

* * * * *